US005273644A

United States Patent [19]

Wegerer

[11] Patent Number: 5,273,644

[45] Date of Patent: Dec. 28, 1993

[54] INTEGRATED REFORMING AND ALKYLATION PROCESS FOR LOW BENZENE REFORMATE

[75] Inventor: David A. Wegerer, Lisle, Ill.

[73] Assignee: UOP, Des Plaines, Ill.

[21] Appl. No.: 960,339

[22] Filed: Oct. 13, 1992

[51] Int. Cl.[5] ..... C10G 35/04; C10G 59/00

[52] U.S. Cl. ..... 208/66; 208/139; 585/310

[58] Field of Search ..... 208/66, 139; 585/310

[56] References Cited

U.S. PATENT DOCUMENTS

| | | | |
|---|---|---|---|
| 4,140,622 | 2/1979 | Herout et al. | 208/93 |
| 4,431,522 | 2/1984 | James, Jr. | 208/134 |
| 4,975,179 | 12/1990 | Harandi et al. | 208/66 |
| 5,082,990 | 1/1992 | Hsieh et al. | 208/66 |

OTHER PUBLICATIONS

Lawrence A. Smith, Jr., "Reformate Alkylation with Refinery Off-Gas Via Catstill Process", AIChE meeting in Philadelphia, Pa. on Aug. 20–23, 1989.

*Primary Examiner*—Howard T. Mars

*Attorney, Agent, or Firm*—Thomas K. McBride; John F. Spears, Jr.

[57] ABSTRACT

The invention is a lower cost combined reforming-benzene alkylation process. The unstabilized liquid product recovered from the reforming reaction zone is not stabilized by passage into a stripping column for the removal of $C_4$-minus hydrocarbons but is instead split into light and heavy fractions, with the light, benzene-containing fraction being passed directly into an alkylation zone.

4 Claims, 1 Drawing Sheet

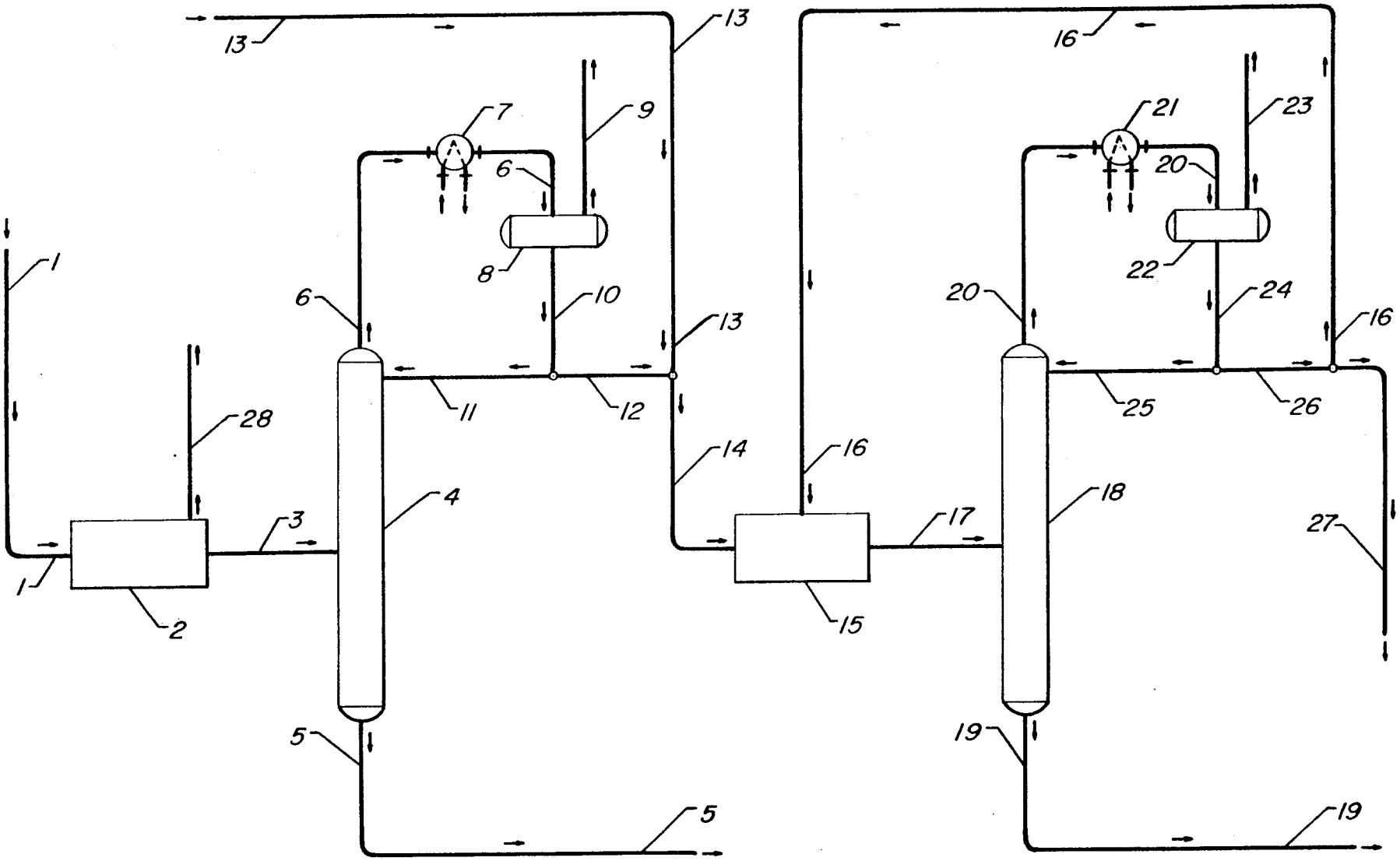
1
1
2
28
3
4
5
5
6
6
7
8
9
10
11
12
13
13
13
14
15
16
16
16
17
18
19
19
20
20
21
22
23
24
25
26
27

INTEGRATED REFORMING AND ALKYLATION PROCESS FOR LOW BENZENE REFORMATE

FIELD OF THE INVENTION

The invention relates to a hydrocarbon conversion process useful in the catalytic reforming of naphtha boiling range hydrocarbon fractions for the production of motor fuel blending components. The invention more specifically relates to an integrated catalytic reforming-alkylation process in which benzene produced in the reforming reaction zone is alkylated with a light olefin.

PRIOR ART

Catalytic reforming is a well known widely practiced process used in a great many refineries to produce high octane motor fuel and aromatic hydrocarbons for petrochemical feed stocks. U.S. Pat. No. 4,431,522 issued to R. B. James, Jr. describes a typical reforming unit process flow including the partial condensation of the reactor effluent to yield a liquid reformate product which is passed into a stripping column to remove light ends.

A process for the reduction of benzene in a reformate by alkylation is disclosed in U.S. Pat. No. 4,140,622 issued to R. C. Herout et al.

The alkylation of reformates with refinery off-gas is also described in a paper by Lawrence A Smith, Jr. presented at the American Institute of Chemical Engineers National meeting in Philadelphia, Pa. on Aug. 20-23, 1989.

SUMMARY OF THE INVENTION

The invention is an improved process for the production of low benzene content reformates. More specifically the invention reduces both the capital costs and utility cost of achieving the results shown in the prior art alkylation processes or the references cited above. The invention allows the elimination of a stripping column, normally a debutanizing column, which is customarily used in a reforming process.

One broad embodiment of the invention may be characterized as a hydrocarbon conversion process which comprises the steps of passing a naphtha boiling range hydrocarbon stream into catalytic reforming zone operated at reforming conditions and producing an unstabilized reforming zone effluent stream; passing the unstabilized reforming zone effluent stream into a fractionation zone designed and operated to separate entering hydrocarbons into a net bottoms stream comprising $C_7$-plus hydrocarbons and essentially free of benzene and a net overhead liquid stream comprising $C_3$ hydrocarbons and benzene; and, passing the net overhead liquid stream and an olefin feed stream into an alkylation zone and recovering a naphtha boiling range product stream having a lower benzene content than the net overhead stream. The fractionation zone may be located in a catalytic distillation column which also contains the alkylation zone.

BRIEF DESCRIPTION OF THE DRAWING

The drawing is a simplified process flow diagram in which a naphtha stream is charged to a reforming zone 2, with the reforming zone effluent passing directly into splitter column 4 and the net overhead of this column being passed directly into the alkylation zone 15.

DETAILED DESCRIPTION AND PREFERRED EMBODIMENTS

Increased concerns about the toxicity and possible carcinogenic nature of benzene have contributed to the enactment of new standards for the benzene content of gasoline. Much of this benzene is produced by catalytic reforming naphtha boiling range material, which is performed to increase the octane number of the naphtha prior to its inclusion in gasoline. As indicated above, proposals have been made to eliminate benzene by alkylation with a light olefin such as derived from a fluidized catalytic cracking (FCC) process. It is an objective of the subject invention to provide a lower cost method of performing such an alkylation.

The subject invention achieves this objective by charging an unstabilized reformate to the alkylation zone and by stabilizing the effluent of the alkylation zone.

The invention may be more fully discerned by reference to the drawing in which a naphtha boiling range feedstream enters the process through line 1 and is passed into a catalytic reforming zone 2. The naphtha boiling range material would normally comprise a feedstream having pentane or butane as its lowest boiling material and containing a complete range of hydrocarbons boiling up to about 400 to 425 degrees F. (204-218 degrees C.). It is also contemplated that the feedstream carried into the reforming zone 2 by line 1 may alternatively comprise a light naphtha fraction having an end boiling point set to include $C_7$ or $C_8$ hydrocarbons as the highest boiling materials. In any event, the entering naphtha stream is processed in a conventional manner by contact with a suitable reforming catalyst maintained at reforming conditions in a reaction zone and the vapor-phase effluent stream of the reaction zone is subjected to customary initial product recovery steps such as partial condensation and recontacting. The separation steps will lead to the production of a hydrogen-rich net off-gas stream removed from the reforming zone through line 28. Within the reforming zone itself, there will be recirculated a hydrogen-rich recycle gas stream not shown to maintain desired process conditions within the reaction zone.

The separation steps within the reforming zone 2 will yield an unstabilized liquid phase reforming zone effluent stream passed through line 3 into an optional splitting column 4. Splitting column 4 is utilized in those instances in which the naphtha feedstream of line 1 contains substantial amounts of heavier ($C_9$- plus) hydrocarbons such that it is desired to remove a stream of heavy naphtha through line 5. The remaining portion of the reforming zone effluent stream is withdrawn through line 6 as an overhead vapor stream which is partially condensed in the overhead condenser 7. The normally gaseous material present in the overhead stream of line 6 is removed from overhead receiver 8 by line 9. This leaves the overhead liquid stream withdrawn through line 10 which is divided into a first portion returned through line 11 to the splitting column 4 as reflux and a second portion removed as a net overhead stream through line 12. The net overhead stream of line 12 will contain an equilibrium concentration of the gaseous materials removed through line 9. It will also contain all of those hydrocarbons which are condensed at the conditions maintained in the overhead receiver 8. Since there is no stripping column located in the reforming zone 2, all of the light hydrocarbons produced in the reforming zone are present to some extent in the reforming zone effluent of line 3 and are thus present to a related extent in the net overhead material of line 12. This unstabilized net overhead material is therefore expected to contain butane, propane, and to a lesser extent dissolved hydrogen, methane and ethane.

The net overhead stream of line 12, an unstabilized reformate, is admixed with an olefin-rich stream fed to the process through line 13. This admixture is carried by line 14 into an alkylation zone 15. The entering materials are contacted with a suitable alkylation catalyst maintained at alkylation-promoting conditions in an alkylation reactor. In the embodiment shown in the invention, a recycle stream comprising light hydrocarbons carried by line 16 is also passed into the alkylation zone 15. The primary purpose of this recycle stream is to provide quench material for interstage cooling of the reaction zone. It is contemplated, however, that any olefinic material present in the recycle stream of line 16 will partake in the alkylation reaction In this regard, it is also possible that a portion of the olefinic feed material of line 13 will be admixed into the recycle stream of line 16 for interstage injection of the olefinic feed material. As a yet further alternative, the olefinic feed material of line 13 may be divided into three or more portions which are passed into the reaction zone at different points in the manner shown in the U.S. Pat. No. 5,120,890.

The alkylation zone may contain initial product recovery steps such as vapor liquid separation, partial condensation, and product concentration. The net product of the alkylation zone is an alkylation zone effluent stream carried by line 17 which comprises the unreacted reactive feed materials of lines 12 and 13 (olefins, aromatics), the unreacted effectively inert feed stream materials, such as paraffins, product alkylbenzenes, and other components of the unstabilized light naphtha originally present in the net overhead stream of line 12. This admixture is passed into a stabilizing or stripping column 18. The column 18 is designed and operated under conditions to separate entering hydrocarbons into a net bottoms stream removed from the process through line 19 as a low benzene naphtha product stream and an overhead vapor stream removed in line 20. The net bottom stream of line 19 is a low benzene content naphtha boiling range product of the process.

The overhead vapor stream of line 20 is passed through an overhead condenser 21 and directed into the overhead receiver 22. Uncondensed light gases such as hydrogen, methane and ethane are removed as an off-gas stream through line 23. At least a portion of this hydrogen is derived from the reforming zone. The condensate is removed through line 24 and divided into a first portion returned to the stripping column in line 25 as reflux and a second portion carried by line 26. This overhead liquid stream would normally consist mainly of the $C_3$ and $C_4$ hydrocarbons present in the unstabilized reformate of line 3 together with similar materials present in the olefin feedstream of line 13. This overhead liquid may be rich in propane or butane and would normally comprise some small amounts of pentanes and dissolved ethane. A first portion of this material is employed as the previously described recycle stream of line 16 with the remaining portion being withdrawn from the process as a net overhead liquid stream carried by line 27.

As previously referred to, the feed material to the reforming zone may comprise a full boiling point range naphtha material or just hydrocarbons boiling in a portion of this boiling point range. The feed stream may also be a stream which is rich in paraffinic $C_6$–$C_8$ hydrocarbons. A primary limiting factor is that the naphtha feedstream to the reforming zone must contain benzene precursor compounds. That is, since the subject application has application in the elimination or reduction of benzene in the reformate, the feed to the reforming zone must contain benzene-producing compounds. Therefore, the subject invention would not normally apply to a process charging a $C_7$-plus or $C_8$-plus feedstream to the reforming zone. Reference may be made to U.S. Pat. No. 4,002,555 for an illustration of the separation of a hydrotreated feed into a light and heavy naphtha chargestock to reforming zones. In this specific reference, the heavy naphtha is removed as a bottoms product of a fractionator and a lighter stream charged to a separate reforming zone is removed as a sidecut.

There are many known methods for recovering a net liquid product from the effluent of a reforming reactor. Often the strategy employed will comprise partial condensation and an initial vapor liquid separation followed by a pressurization of the respective vapor and liquid phases and a "recontacting" of the vapor and liquid phases. The recontacted material is then subjected to a second stage of vapor liquid separation to yield a higher purity hydrogen stream and a second liquid phase material. It is this liquid phase material or its equivalent which would be passed through line 3 of the drawing into the splitting column 4. If the feedstream to the reforming zone is a relatively light naphtha, this liquid phase stream recovered from the recontacting operation could be passed directly into the alkylation zone eliminating the need for the splitting column 4 and the accompanying overhead system shown in the drawing. Care must be given to avoid the alkylation of heavier aromatics such as $C_7$ and $C_8$ aromatics which may lead to the product having a higher end point than desired.

Methods for recovering a liquid product from a catalytic reforming zone are illustrated in U.S. Pat. Nos. 3,520,800; 4,333,819; 4,364,820; and 4,374,726. These references are incorporated herein in their entirety for their teaching of methods suitable for recovering an unstabilized reformate. It is to be noted that all of these references employ at least one stripping column which removes a net overhead liquid product in producing the final reformate. Therefore, the equipment employed in the reforming zone of the subject invention would be different from the process flow illustrated in these references to the extent that the reforming zone of the subject invention does not comprise a stripping column required to produce a stabilized reformate.

In the reforming zone, the naphtha chargestock preferably in admixture with hydrogen is contacted with a suitable reforming catalyst. This contacting may be accomplished in either a fixed bed system, a moving bed system or a fluidized bed system. It is understood that the reaction zone may comprise two or more separate reactors with suitable means for reheating reactants between the reactors to overcome the endothermic nature of the reactions which occur during the reforming process. Reforming conditions in general include a pressure of from about 446 kPa (50 psig) to about 2514 kPa (350 psig). A preferred pressure range is from about 446 kPa to about 791 kPa (100 psig). Reforming conditions in general also include a temperature in the range of about 427 degrees C. (800 degrees F.) to about 593 degrees C. (1100 degrees F.) and preferably about 482 degrees C. to about 566 degrees C. The reforming conditions preferably also include the recirculation of sufficient hydrogen-rich gas through the reaction zone to maintain the presence of about 5 to about 10 moles of hydrogen per mole of hydrocarbon chargestock. As used herein the term "rich" is intended to refer to a concentration of the indicated chemical or class of chemicals greater than 50 mole %. The liquid hourly space velocity in the overall reaction zone is normally within the range of about 1 to about 5 hours$^{-1}$. The preferred catalytic reforming zone will employ a moving bed reactor with continuous regeneration of the catalyst in an external catalyst regeneration zone.

The preferred reforming catalyst comprises a spherical alumina support having dispersed thereon platinum, tin, halogen and optionally at least one promoter such as ruthenium, iridium, rhenium or germanium. Further information on reforming conditions and suitable reforming catalyst may be attained by reference to U.S. Pat. Nos. 4,012,313; 4,714,538; and 4,737,262 which are incorporated herein for their teaching as to reforming conditions and catalyst compositions. The reforming catalyst may alternatively comprise a zeolitic material such as L zeolite.

The alkylation zone is operated at conditions which cause at least some of the entering benzene to react with the available alkylating agents such as light olefins. The benzene is thereby consumed and $C_8$ to $C_{12}$ alkylaromatic hydrocarbons, such as ethylbenzene, diethylbenzene, ethyltoluene, isopropyl benzene, di-isopropyl benzene, or isopropyltoluene are produced.

High purity streams consisting of one olefin may be employed as the alkylating agent of the invention, but mixtures of olefins will suffice. Preferably, the olefin stream is rich in olefins. The preferred composition of an olefin stream which is utilized as alkylating agent will be influenced by several factors. One of the most important will be the reactions promoted by the catalyst employed in the benzene alkylation zone and the effects of olefin feed stream composition on the reaction zone product distribution. With some catalysts, it may be beneficial to utilize a high purity olefin stream to minimize the presence of light paraffins such as ethane, propane, and butane. However, it is preferred to utilize a catalyst which will tolerate various amounts of these unreactive light hydrocarbons. This allows the use of lower purity gas streams. Also, streams which are higher in paraffin or inert gas concentrations may be used to improve reactor temperature control by means of absorbing heat released by the alkylation reaction. One such gas stream is that produced as the overhead product stream of a stripping column employed in a typical FCC gas concentration plant. This gas stream may comprise methane, ethane, ethylene, propane, propylene, butane and various butenes. An olefin-rich $C_3$ to $C_4$ stream derived from the stripping column overhead may also be used.

A preferred catalyst for use in the subject process is a solid phosphoric acid (SPA) catalyst. One reason for this preference is the propensity of SPA catalyst to produce monoalkylated aromatic hydrocarbons from benzene and propylene, relative to most other catalysts. Suitable solid phosphoric acid catalysts are available commercially. As used herein, the term "SPA catalyst" or its equivalent is intended to refer generically to a solid catalyst which contains as one of its principal raw ingredients an acid of phosphorus such as ortho-, pyro- or tetraphosphoric acid. These catalysts are normally formed by mixing the acid with a siliceous solid carrier to form a wet paste. This paste may be calcined and then crushed to yield catalyst particles, or the paste may be extruded or pelleted prior to calcining to produce more uniform catalyst particles. Alternatively, the acid of phosphorous may be impregnated onto a support. In either case, the carrier is preferably a naturally occurring porous silica-containing material such as kieselguhr, kaolin, infusorial earth and diatomaceous earth. A minor amount of various additives such as mineral talc, fullers earth and iron compounds including iron oxide may have been added to the carrier to increase its strength and hardness. The combination of the carrier and the additives normally comprises about 15–40 wt. % of the catalyst, with the remainder being the phosphoric acid. However, the amount of phosphoric acid used in the manufacture of the catalyst may vary from about 8–80 wt. % of the catalyst as described in U.S. Pat. No. 3,402,130. The amount of the additives may be equal to about 3–20 wt. % of the total carrier material. Further details as to the composition and production of suitable SPA catalysts may be obtained from U.S. Pat. Nos. 3,050,472; 3,050,473; 3,132,109; 5,043,509; 5,059,737; and 5,081,086 and from other references.

The subject process is not limited to the use of SPA catalyst and may be performed using a catalyst suitable for the relatively easy task of promoting the alkylation of benzene. Zeolitic catalysts comprising MFI, Beta or Y zeolites including dealuminated Y zeolites can be employed. A homogeneous catalyst system may also be employed if so desired.

Suitable alkylation conditions will be dependent on such variable factors as the type and activity of the catalyst, the olefinic agents charged to the alkylation zone and the required degree of benzene alkylation. Representative alkylation conditions for use with SPA catalysts include a general temperature range of from about 150 to about 300 degrees C., a pressure of from about 20 to about 70 atmospheres and a liquid hourly space velocity of about 1.0 to about 10. The pressure and temperature are preferably correlated to provide mixed-phase conditions in the reactor when SPA catalyst is employed. A molar excess of light olefin alkylating agent over benzene is preferred.

As mentioned above, it is contemplated that in some instances it may be desirable to depart from the flowscheme shown in the drawing by employing catalytic distillation technology. This would eliminate the need for separate fractionation (splitting column) and alkylation equipment if the required fractionation can be adequately performed in a catalytic distillation environment. The fractionation performed in the catalytic distillation column could separate out heavy hydrocarbons not intended as alkylation zone feed while also separating out the alkylation products The alkylation of aromatic hydrocarbons via catalytic distillation is described in U.S. Pat. Nos. 5,043,506; 5,055,627; 5,080,871 and 5,118,896.

The conditions employed in an alkylation zone within the catalytic distillation column will include mixed-phase conditions and may be dictated more by vapor-liquid equilibrium than reaction kinetic concerns. It would be preferred to employ an acidic catalyst such as a Y zeolite retained within a structured packing such as shown in U.S. Pat. No. 5,073,236.

One embodiment of the invention may accordingly be characterized as a hydrocarbon conversion process which comprises the steps of passing a light naphtha feed stream into a reforming reaction zone and recovering a liquid phase reforming zone effluent stream comprising propane, benzene and dissolved hydrogen; passing the liquid phase reforming zone effluent stream into a fractionation column designed and operated to separate entering hydrocarbons into a net bottoms stream comprising $C_7$-plus hydrocarbons and essentially free of benzene and a net overhead liquid stream comprising $C_3$ hydrocarbons and benzene; passing the net overhead liquid stream and an olefin feed stream into an alkylation zone, and recovering a naphtha boiling range product stream having a lower benzene content than the net overhead stream.

What is claimed:

1. A hydrocarbon conversion process which comprises the steps:

a. passing a naphtha boiling range hydrocarbon stream into a catalytic reforming zone operated at reforming conditions and producing an unstabilized reforming zone effluent stream;

b. passing the unstabilized reforming zone effluent stream into a fractionation zone designed and operated to separate entering hydrocarbons into a net bottoms stream comprising $C_7$-plus hydrocarbons and which is essentially free of benzene and a net overhead liquid stream comprising $C_3$ hydrocarbons and benzene;

c. passing the net overhead liquid stream and an olefin feed stream into an alkylation zone and recovering a naphtha boiling range product stream having a lower benzene content than the net overhead stream.

2. The process of claim 1 further characterized in that the alkylation zone and the fractionation zone are located within a catalytic distillation zone.

3. A hydrocarbon conversion process which comprises the steps of:

a. passing a light naphtha feed stream into a reforming reaction zone and recovering a liquid phase reforming zone effluent stream comprising propane, benzene and dissolved hydrogen;

b. passing the liquid phase reforming zone effluent stream into a fractionation column designed and operated to separate entering hydrocarbons into a net bottoms stream comprising $C_7$-plus hydrocarbons and essentially free of benzene and a net overhead liquid stream comprising $C_3$ hydrocarbons and benzene;

c. passing the net overhead liquid stream and an olefin feed stream into an alkylation zone, and recovering a naphtha boiling range product stream having a lower benzene content than the net overhead stream.

4. The process of claim 3 further characterized in that liquid phase reforming zone effluent stream and the net overhead liquid stream comprise methane and ethane.

* * * * *